United States Patent [19]

Jones

[11] Patent Number: 4,596,405

[45] Date of Patent: Jun. 24, 1986

[54] ADJUSTABLE LENGTH POLE

[75] Inventor: John P. Jones, Colorado Springs, Colo.

[73] Assignee: Norma J. Jones, Colorado Springs, Colo.

[21] Appl. No.: 654,242

[22] Filed: Sep. 25, 1984

[51] Int. Cl.[4] ..... A63C 11/22

[52] U.S. Cl. ..... 280/823; 403/112; 135/75

[58] Field of Search ..... 280/823; 403/109, 112; 135/68, 69, 75

[56] References Cited

U.S. PATENT DOCUMENTS 1,967,355 7/1974 Edwards ..... 280/823

3,722,903 3/1973 Jones ..... 280/823

*Primary Examiner*—David M. Mitchell

*Assistant Examiner*—Richard M. Camby

*Attorney, Agent, or Firm*—Harvey B. Jacobson

[57] ABSTRACT

An adjustable length pole is provided including first and second pole members having slidingly telescopingly engaged inner and outer adjacent ends, respectively. Connecting structure is provided connecting the ends for longitudinal adjustment between predetermined stepped positions of adjustment and the connecting structure includes detent structure defining each of the predetermined positions and yieldingly resisting shifting of the ends from each predetermined position. The connecting structure further includes adjustment structure shiftable relative to one of the ends with the other end and also shiftable relative to the other end between position shifting allowing and position retaining positions. The adjustment structure is operative to non-yieldingly retain the ends in any of the predetermined positions of extension thereof when in the position retaining position and operative to allow shifting of the ends between the predetermined extended positions thereof when in the position shifting allowing position. Further, the connecting structure also is operative to prevent further extension of the ends past a maximum extended position defined by the connecting structure, even when the adjusting structure is in the position shifting allowing position.

3 Claims, 9 Drawing Figures

ADJUSTABLE LENGTH POLE

BACKGROUND OF THE INVENTION

An adjustable length rod or pole is provided and has been designed for incorporation into the manufacture of ski poles, but the rod or pole may have other uses in the tent pole, bracing and support heels, etc.

SUMMARY OF THE INVENTION

The pole of the instant invention includes first and second pole members having slidingly telescopingly engaged inner and outer ends, respectively, and connecting means connecting the ends for relative longitudinal adjustment between predetermined stepped positions of adjustment. The connecting means includes detent means defining each of the predetermined positions and yieldingly resisting shifting of the ends from each of the predetermined positions. Further, the connecting means also includes adjustment structure shiftable relative to one of the ends with the other end and relative to the other end between position shifting allowing and position retaining positions. The adjustment means is operative to non-yieldingly retain the ends in any of the predetermined positions of adjustment when in the position retaining position and to allow shifting of the ends between the predetermined positions when in the the position shifting allowing position.

The adjusting means includes a sleeve telescoped over the ends, rotatable relative thereto and threadedly engaged with the aforementioned other end. The sleeve is threadedly shiftable between loosened and tightened positions on the other end defining the shifting allowing and position retaining positions, respectively. Further, the detent means includes structure positively preventing shifting of the ends past the last predetermined position of extension of the ends relative to each other, even when the adjustment means is in the shifting allowing position thereof.

The main object of this invention is to provide an adjustable length pole which may be extended and retracted between a plurality of predetermined relatively telescoped positions.

Another object of this invention is to provide an adjustable length pole wherein detent structure is provided defining each of the predetermined positions of adjustment of the pole.

Still another important object of this invention is to provide an adjustable length pole including relatively telescoped adjacent pole section ends and wherein the pole section ends are connected together against lengthwise separation.

A final object of this invention to be specifically enumerated herein is to provide an adjustable length pole in accordance with the preceding objects and which conform to conventional forms of manufacture, be of simple construction and easy to use so as to provide a device that will be economical feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
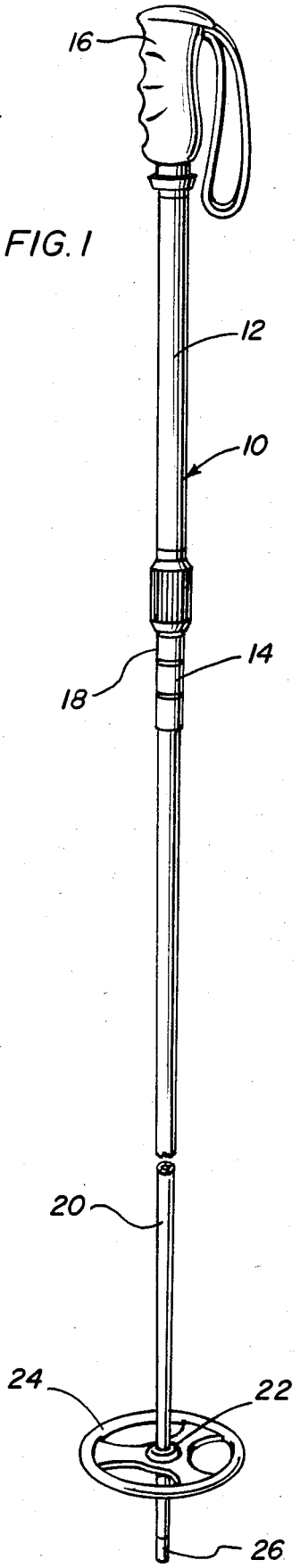
FIG. 1 is a perspective view of a ski pole constructed in accordance with the present invention.
Figure 2:
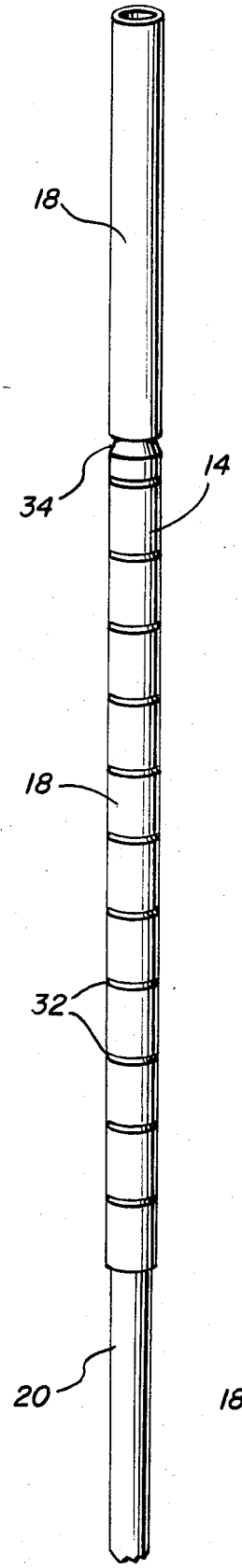
FIG. 2 is an enlarged fragmentary perspective view of the upper end portion of the lower end section of the ski pole.
Figure 7:
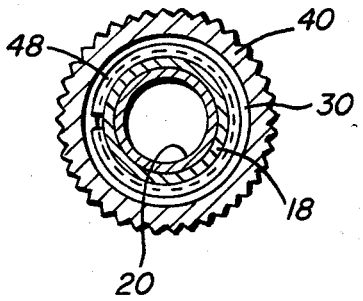
FIG. 7 is an enlarged transverse sectional view taken substantially upon the plane indicated by the section line 7—7 of FIG. 3.
Figure 8:
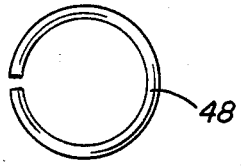
FIG. 8 is a plan view of the split detent and locking ring of the ski pole.

Referring now more specifically to the drawings, the numeral 10 generally designates the ski pole of the instant invention. The ski pole 10 includes upper and lower pole sections 12 and 14 which are relatively telescopingly engaged. The upper end of the section 12 includes a conventional handgrip 16 and the upper section 12 is of cylindrical tubular construction so as to telescopingly receive the upper end of the section 14 therein with the section 14 extending downwardly from the lower end of the section 12.

The section 14 includes an upper outer tubular member 18 and a lower inner tubular member 20. The upper end of the tubular member 20 is telescoped and secured within the tubular member 18 and projects downwardly from the lower end of the tubular member 18. That portion of the tubular member 20 which projects downwardly from the lower end of the tubular member 18 tapers downwardly and has a conventional basket keeper 22 and basket 24 supported therefrom. The extreme lower end of the tubular member 20 includes a conventional ice tip 26 supported therefrom. Accordingly, the ski pole 10, other than its adjustable length feature, may be considered as structurally and operationally conventional.

The lower end of the section 12 is slightly diametrically reduced and equipped with external threads 28 and the extreme lower terminal end of the section 12 defines a slightly inwardly bevelled shoulder 30. In addition, the tubular member 18 is equipped with a plurality of longitudinally spaced circumferential grooves 32 which are generally semi-cylindrical in cross sectional in shape. However, the depth of the grooves 32 is slightly less than the radius of transverse curvature thereof. Further, the tube member 18 is also provided with an uppermost circumferential groove 34 which is deeper than the grooves 32 and includes a downwardly flaring lower portion 36 and defines an upper generally radial annular shoulder 38 facing downwardly along the tube member 18.

A sleeve 40 including a knurled outer surface 42 is provided and is snugly slidingly received over the tube member 18. The interior of the upper end of the sleeve 40 is slightly diametrically enlarged and internally threaded as at 44 and threadedly engageable over the threads 28. The diametrically enlarged internal threaded portion 44 of the sleeve 40 terminates downwardly in a bevelled shoulder 46 opposing the internal shoulder 30 of the upper pole section 12. Finally, a radially split retaining ring 48 is provided and slidably disposed on the tube member 18. The ring 48 is circular in radial cross section and is constructed of resilient metal. The ring 48 is of an internal size to be slightly expanded over the tube member 18 for sliding between adjacent grooves 32 and the groove 34, and the ring 48, when nonexpanded, seats at least substantially fully in either of the grooves 32 or the groove 34.

Figure 9:
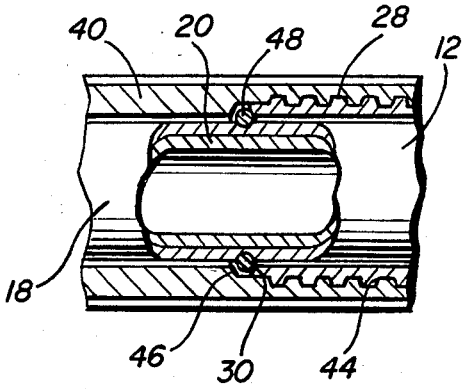
FIG. 9 is a fragmentary enlarged longitudinal vetical sectional view illustrating the adjustable components of the invention in relative positions locking the ski pole against longitudinal extension or retraction.
Figure 3:
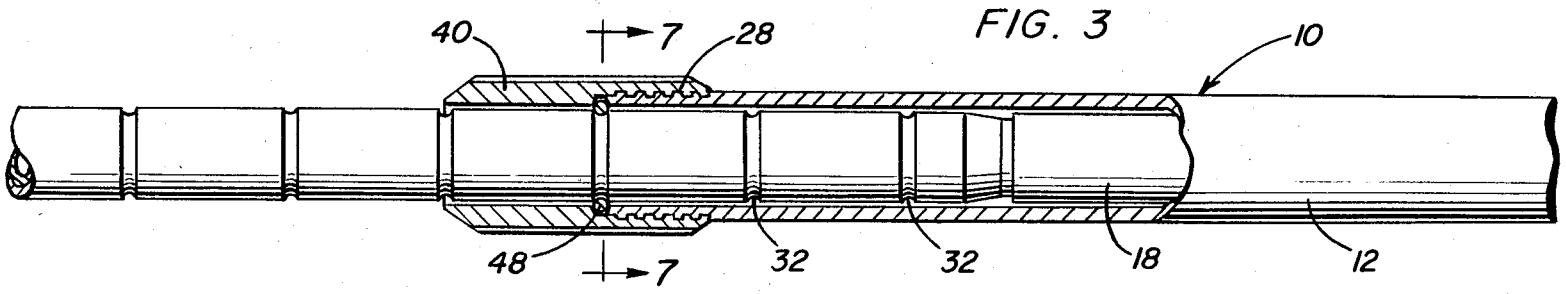
FIG. 3 is an enlarged fragmentary longitudinal sectional view of the relatively telescoped ends of the ski pole sections comprising the ski pole and with the various adjustable features of the ski pole in positions relative to each other locking the pole sections against extension and retraction relative to each other.
Figure 4:
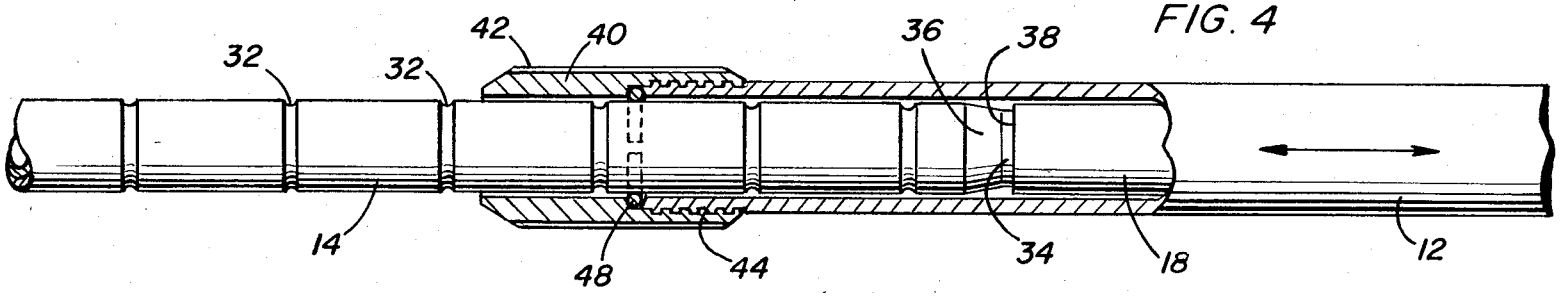
FIG. 4 is an enlarged fragmentary longitudinal sectional view similar to FIG. 3 and illustrating the locking sleeve of the ski pole in a loosened condition allowing longitudinal extension and retraction of the pole sections relative to each other.

When the components of the ski pole 10 are assembled as illustrated in FIGS. 3 and 9 of the drawings with the ring 48 received between the shoulder 46 and the inner bevel 30 and seated in one of the grooves 32, the sections 12 and 14 may be positively locked together against relative longitudinal extension and retraction by tightening the sleeve 40 on the diametrically reduced externally threaded lower end portion of the upper pole section 12. By tightening the sleeve 40 on the section 12, the ring 48 is at least closely opposed between the inner shoulder 30 and the shoulder 46 and thereby prevented from expanding out of the groove 32 in which the ring 48 is seated. This, of course, locks the upper and lower pole sections 12 and 14 against extension and retraction relative to each other.

If, on the other hand, the sleeve 28 is loosened one-half turn, the spacing between the inner shoulder 30 and the shoulder 46 is increased thereby enabling expansion of the ring 48 out of the associated groove 32, although the resiliency of the ring 48 tends to maintain the ring seated within the groove 32. However, when the sleeve 40 has been loosened one-half turn, the upper section 12 may be longitudinally extended and retracted relative to the lower section 14 and each time the ring 48 registers with a new groove 32, the ring 48 will function as a detent yieldingly resisting movement of the section 12 relative the section 14. Thus, each of the positions of extensions and retraction of the sections 12 and 14 relative to each other defined by the grooves 32 and 34 comprises a detent position. Once a new detent position has been established, the sections 12 and 14 may be locked against extension and retraction merely by tightening the sleeve 40 one-half turn .

Figure 5:
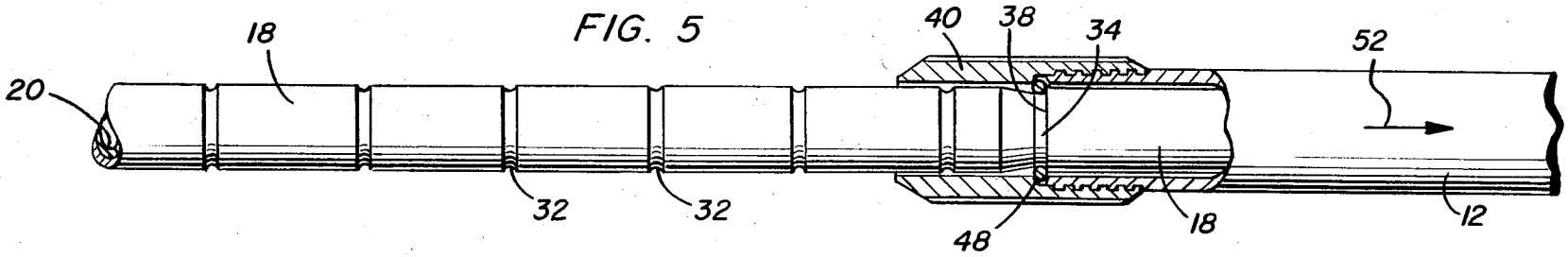
FIG. 5 is a fragmentary longitudinal sectional view similar to FIG. 4 and illustrating the manner in which the pole sections are prevented from lengthwise separation relative to each other even when the sleeve is in a loosened condition.
Figure 6:
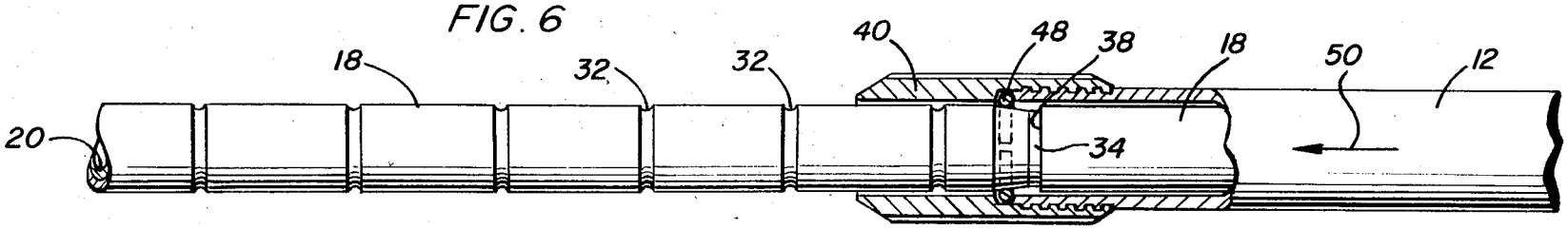
FIG. 6 is a fragmentary longitudinal vertical sectional view similar to FIG. 5 and illustrating the manner in which the ski pole sections may be shifted to positions increasing their telescopic engagement from the limit positions of extension relative to each other illustrated in FIG. 5.

With attention now invited more specifically to FIGS. 5 and 6 of the drawings, once the sleeve 40 has been loosened one-half turn the sections 12 and 14 may be longitudinally shifted relative to each other and the ring 48 may even be shifted to a position within a groove 34. The flared portion 36 of the groove 34 enables the section 12 to be collapsed relative to the section 14, inasmuch as the flared portion 36 will be capable of camming the ring 48 into an expanded position sufficient to allow longitudinal shifting of the section 12 relative to the section 14 in the direction of the arrow 50 in FIG. 6. However, in view of the generally radial annular shoulder 38 defined by the groove 34, the section 12 may not be moved in the direction of the arrow 52 in FIG. 5 past the relative positions of the sections 12 and 14 illustrated in FIG. 5. The shoulder 46 and shoulder 48 act to retain the ring 48 within the groove 34 as pressure is applied in the direction of the arrow 52. Accordingly, inasmuch as the radial thickness of the ring 48 is considerably greater than the radial clearance between the section 14 and the inner diameter of the sleeve 40, the section 12 may not be shifted in the direction of the arrow 52 past the position of the section 12 illustrated in FIG. 5, unless the sleeve 42 is completely unthreaded from the section 12. Even if the section 12 is unthreaded from the sleeve 40, the sleeve 40 still may not be moved in the direction of the arrow 52 illustrated in FIG. 5 past the position of the sleeve illustrated in FIG. 5.

It is envisioned that the relatively shiftable components of the ski pole 10 will be constructed of metal which resists corrosion. However, if the pole is to be manufactured in a form other than a ski pole, it is very possible that other materials may be used in the construction thereof. Most certainly, lightweight high strength plastics may be used in the construction of the pole when extreme pressures are not to be placed thereon.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An adjustable length pole including first and second pole members having slidingly telescopically engaged inner and outer ends, respectively, said inner end including a plurality of longitudinally spaced circumferential detent grooves formed in the outer surface thereof with each of said grooves being generally semi-cylindrical in cross section and of a depth slightly less than the radius of curvature thereof, a split resilient retainer ring expanded over said inner end immediately adjacent and outwardly of the terminal end of said outer end with which said inner end is telescopically engaged, said snap ring being slidable along said inner end and seatable in said grooves, said inner end also including a circumferential stop groove formed in the outer surface thereof intermediate the terminal end of said inner end and the adjacent detent groove, said stop groove defining a generally radial shoulder adjacent said terminal end and a flared shoulder adjacent said detent grooves, said snap ring also being seatable in said stop groove, a sleeve having a first interior end snugly slidingly telescoped over said inner end and including a diametrically enlarged and internally threaded second interior end adjustably threaded over said outer end, the terminal end of said outer end including an inwardly bevelled end edge, said sleeve, between said first and second interior ends, defining an interior shoulder bevelled oppositely relative to said end edge and slightly spaced from and opposing the latter, said snap ring being disposed between said interior shoulder and bevelled end edge, said ring being cammable outwardly of said detent grooves and also outwardly of said stop groove over said flared shoulder toward said detent grooves when said sleeve is threadedly adjusted on said outer end to space said end face and said interior shoulder at least the axial thickness of said ring apart and said end face and shoulder, when said sleeve is threadedly adjusted on said outer end to space said end face and interior shoulder apart less than the axial thickness of said ring being operable to tightly cam said ring into one of said grooves with which said ring is registered against camming of said ring out of the last mentioned groove, the radial extent of said radial shoulder of said stop groove being operative to prevent said retainer ring from being cammed from said stop groove past said radial shoulder, even when said interior shoulder and end face are spaced apart a distance greater than the axial thickness of said ring.

2. The pole of claim 1 wherein said pole comprises a ski pole having upper and lower ends comprising said outer and inner ends, respectively.

3. The pole of claim 2 wherein said upper end includes a handgrip and said lower end includes a basket supported therefrom.

* * * * *